US007377820B2

(12) United States Patent
Osada et al.

(10) Patent No.: US 7,377,820 B2
(45) Date of Patent: May 27, 2008

(54) TERMINAL HAVING A PROTRUSION FOR PREVENTING INCORRECT INSERTION

(75) Inventors: Tsuyoshi Osada, Ishi (JP); Ping Chen, West Bloomfield, MI (US)

(73) Assignee: J.S.T. Corporation, Farmington Hills, MI (US)

( * ) Notice: Subject to any disclaimer, the term of this patent is extended or adjusted under 35 U.S.C. 154(b) by 0 days.

(21) Appl. No.: 10/993,245

(22) Filed: Nov. 19, 2004

(65) Prior Publication Data

US 2006/0110976 A1 May 25, 2006

(51) Int. Cl.
*H01R 13/64* (2006.01)

(52) U.S. Cl. ..... 439/680

(58) Field of Classification Search ..... 439/525, 439/595, 839, 752.5, 744, 752, 344, 352, 439/357, 852, 272, 680, 587–588, 274–275
See application file for complete search history.

(56) References Cited

U.S. PATENT DOCUMENTS 4,832,615 A * 5/1989 Thakrar et al. ..... 439/272
5,225,147 A 7/1993 Lin et al.
5,626,499 A 5/1997 Yagi et al.
6,000,976 A 12/1999 Takagishi et al.
6,068,524 A * 5/2000 Koumatsu ..... 439/752.5
6,227,915 B1 5/2001 Sakatani et al.
6,283,102 B1 9/2001 Nelson et al.
6,520,801 B2 * 2/2003 Tabata et al. ..... 439/595
6,524,143 B2 2/2003 Chen
6,527,601 B2 * 3/2003 Chen ..... 439/852
6,595,800 B2 7/2003 Yuasa et al.
6,729,904 B2 * 5/2004 Nankou et al. ..... 439/595

FOREIGN PATENT DOCUMENTS

EP 1 369 960 A1 12/2003

OTHER PUBLICATIONS

U.S. Appl. No. 10/374,691.

* cited by examiner

*Primary Examiner*—Edwin A León
(74) *Attorney, Agent, or Firm*—Osha Liang LLP

(57) ABSTRACT

A terminal for preventing incorrect insertion into a housing and a method of correctly inserting a terminal into a housing of a connection. The terminal includes a frame that is adapted to be received into a cavity in the housing and a wire operatively connected to the frame. A protrusion, which extends from the frame, includes a leading side, a top side, and a trailing side. The protrusion is configured to only allow a desired orientation of the terminal when inserted into the cavity. The frame and protrusion are formed from a single piece of sheet metal. The method includes orienting the terminal such that a protrusion disposed on the terminal is aligned with a slot formed in a cavity in the housing and inserting the terminal into the cavity in the housing such that the protrusion passes through the slot.

9 Claims, 4 Drawing Sheets

TERMINAL HAVING A PROTRUSION FOR PREVENTING INCORRECT INSERTION

BACKGROUND OF INVENTION

Terminals formed from sheet metal are commonly used to connect individual electrical wires to housings that combine electrical wires into a connector. Generally, the terminals must be inserted into cavities within the housing in a particular orientation to match a mating piece in the housing. To ensure correct orientation, each terminal will typically have a protrusion or other asymmetric feature that is matched with a slot formed in the cavity.

FIG. 1 shows a prior art terminal 1 being correctly inserted (in the direction of insertion 10) into a cavity 5 formed in a housing 6. The frame of the terminal 1 is made from a single piece of sheet metal that is stamped and formed into a generally rectangular shape. This terminal 1 includes a crimping portion 11 that may be used to attach an electrical wire (not shown) to the terminal 1. Other terminals 1 may use soldering or other methods to secure the wire to the terminal 1. A protrusion 3 has been stamped from the sheet metal. The protrusion 3 has a leading side 27 and a trailing side 28. The protrusion 3 is sized and oriented to match with a slot 4 formed in a cavity 5 in the housing 6. The housing 6 may have a plurality of cavities 5 for accepting additional terminals 1. When correctly oriented as shown in FIG. 1, the terminal 1 may be inserted into the cavity 5 with little or no force to connect with a securing mechanism (not shown) housed within the cavity 5. Typically, the securing mechanism is a clip formed within the housing that snaps behind the frame of the terminal 1.

Terminals 1 such as the one shown in FIG. 1 may be used in applications requiring waterproof connectors. There are two primary methods for waterproofing connectors. One is to individually waterproof each terminal 1 in what is commonly referred to as an individually-waterproofed-cell type connector, which is shown in FIGS. 2A and 2B. The other primary approach is to use a collectively-waterproofed type connector as shown in FIG. 3.

In FIG. 2A, the terminal 1 has wire 22 crimped in the crimping portion. An individual sealing element 21 is attached to the wire 22. The sealing element 21 may be attached by crimping it onto the wire with a portion of the terminal 1, by using adhesives, or by any other method known in the art. Typically, the sealing element 21 is substantially cylindrical. In this sealing arrangement, the housing 6 may have a sealing piece 20 extending from it. The sealing piece 20 may be integrally formed with the housing (i.e. molded together), or it may be attached after manufacture. The sealing piece 20 shown in FIG. 2A is a single block formed with through holes 25 that are sized to allow the terminal 1 pass through with minimal contact. As an alternative to the single sealing piece 20, some housings 6 have hollow cylinders extending from each cavity 5. As the terminal 1 is inserted, the sealing element 21, which has a diameter larger than the width of the terminal 1, forms a seal with the sealing surface 23 inside the through hole 25. The sealing element 21 is typically rubber or some other elastomer, and the sealing piece 20 is typically plastic or resin, for example.

In FIG. 2B, a closer view of an individually-waterproofed-cell type connector is shown. The terminal 1 in FIG. 2B is similar to the terminal 1 in FIG. 2A except that in FIG. 2B, the terminal 1 has a tab 26 instead of a protrusion 3. The tab 26 performs the same function as the protrusion 3 shown in FIG. 1. The tab 26 is generally only used as an alternative to a protrusion 3 when the terminal 1 is formed with sheet metal that is sufficiently thick to not cut or otherwise damage the sealing member 24 and to have sufficient mechanical strength.

In FIG. 3, a collectively-waterproofed type connector is shown. Instead of individual sealing elements 21 as shown in FIG. 2A, a collectively-waterproofed type connector uses a single sealing member 24 to seal against wires 22 connected to multiple terminals 1. The sealing member 24 seals against an inside surface of a sealing extension 29 of the housing 6. The sealing member 24 includes multiple through holes 25 that correspond to each cavity 5 in the housing 6. The through holes 25 are sized to be smaller than the terminal 1 and the attached wire 22. The material for the sealing member 24 is typically rubber or other elastomer that is sufficiently compliant to allow the terminal 1 to pass through without tearing. After the terminal 1 passes through the sealing member 24, the sealing member 24 seals against the wire 22.

Turning to FIG. 4, a cross section of a prior art terminal 1 is shown. In FIG. 4, the terminal 1 is being incorrectly inserted into the cavity 5. The terminal 1 is oriented such that the protrusion 3 is on the opposite side of the slot 4, which is incorrect. As the terminal 1 is incorrectly inserted, the leading side 27 of the protrusion 3 contacts the housing 6. Because of the amount of interference D of the protrusion 3 with the housing 6, a normal force 12 is exerted on the protrusion 3, which is intended to prevent the incorrect insertion and alert the person or mechanism inserting the terminal 1 to the incorrect insertion.

A common problem experienced with the two-sided protrusion 3 is that it may be insufficient for preventing incorrect insertion. In some instances, a terminal 1 may be smaller than 2 mm. Accordingly, the sheet metal, from which terminal 1 is made, may be very thin. Enlarging protrusion 3 relative to the size of the terminal 1 increases interferences, which increases the resistance to incorrect insertion. However, because the protrusion is stamped from sheet metal, enlarging the protrusion 3 thins the wall of the protrusion 3, which reduces the mechanical strength of the protrusion 3. If the protrusion 3 is too weak, it will deform and allow the terminal 1 to be incorrectly inserted. This may occur regardless of the size of the terminal 1.

If the protrusion 3 is reduced in size relative to the terminal 1, it will be stronger. This, however, reduces the amount of interference D, which reduces the resistance to incorrect insertion. As a result, a person inserting the terminal 1 may accidentally force the terminal 1 into an incorrect orientation. If the smaller protrusion 3 is strong enough to not fail, it may instead damage the housing 6, which is typically made from a resin, plastic, or other material weaker than metal. This is as undesirable as a protrusion 3 that fails.

What is still needed is a protrusion that has a balance of strength and size that can be formed in the sheet metal of the terminal.

SUMMARY OF INVENTION

In one aspect, the present invention relates to a terminal for preventing incorrect insertion into a housing. The terminal includes a frame that is adapted to be received into a cavity in the housing and a wire operatively connected to the frame. A protrusion, which extends from the frame, includes a leading side, a top side, and a trailing side. The protrusion is configured to only allow a desired orientation of the terminal when inserted into the cavity. The frame and protrusion are formed from a single piece of sheet metal.

In another aspect, the present invention relates to a method of correctly inserting a terminal into a housing of a connector. The method includes orienting the terminal such that a protrusion disposed on the terminal is aligned with a slot formed in a cavity in the housing and inserting the terminal into the cavity in the housing such that the protrusion passes through the slot. The terminal includes a frame adapted to be received into the cavity in the housing, a wire operatively connected to the frame. The protrusion, which extends from the frame, includes a leading side, a top side, and a trailing side. The frame and protrusion are formed from a single piece of sheet metal.

Other aspects and advantages of the invention will be apparent from the following description and the appended claims.

DETAILED DESCRIPTION

In one aspect, the present invention provides a terminal for connecting a wire to a connector. More specifically, the terminal includes a protrusion designed to prevent incorrect insertion of the terminal into the housing of the connector.

A problem with the typical prior art protrusion on terminals is that the two-sided shape is insufficiently self-supporting. As discussed above, when enlarged to increase interference and resistance to incorrect insertion, the protrusion becomes weak and susceptible to failure. When the protrusion is small to gain strength, it may provide insufficient resistance to incorrect insertion, which can damage the housing.

Another design concern exists when the terminal is used with a collectively-waterproofed type connector. A large protrusion may damage the sealing member during insertion of the terminal. Further, sudden bends and sharp corners may also result in damage to the sealing member.

Figure 5B:
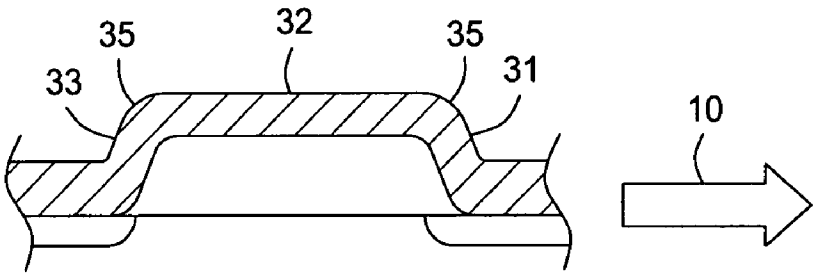
FIG. 5B shows a cross section of the protrusion shown in FIG. 5A. The cross section is parallel to the direction of insertion.
Figure 5C:
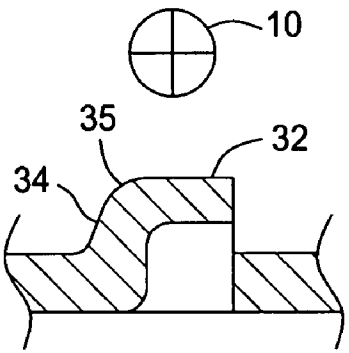
FIG. 5C shows a cross section of the protrusion shown in FIG. 5A. The cross section is perpendicular to the direction of insertion.
Figure 5A:
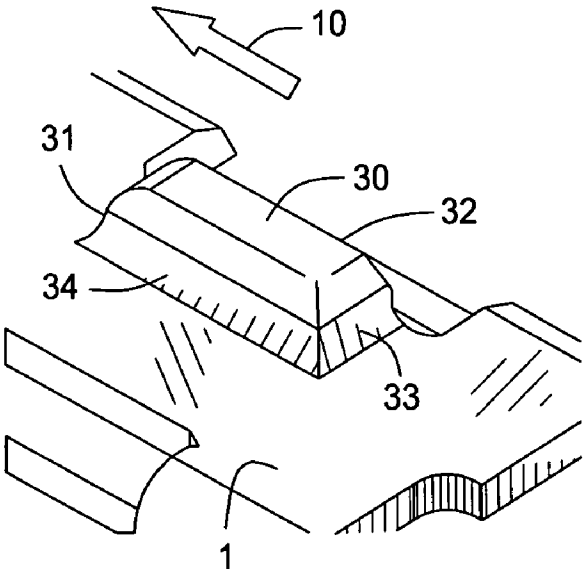
FIG. 5A shows a terminal having a protrusion in accordance with one embodiment of the present invention.

In FIGS. 5A, 5B, and 5C, a protrusion 30 in accordance with one embodiment of the present invention is shown. The protrusion 30 includes a leading side 31, a top side 32, and a trailing side 33. The protrusion 30 has been stamped out of the sheet metal that forms the terminal 1. The protrusion further includes one lateral side 34 that adjoins the other three sides. In one embodiment, the top side 32 is parallel with the direction of insertion 10, and the leading side 31 and trailing side 33 have the same height and angle relative to the top side 32. In other embodiments, the leading side 31 and trailing side 33 may vary in height and angle relative to the top side 32, which would provide a top side 32 that is not parallel with the direction of insertion 10. Between each substantially planar side of protrusion 30, there is a curved transition 35. This is partly a product of the stamping process, but the curved transitions 35 also provide surfaces that reduce the potential to damage the housing and the sealing member, if there is one, during insertion of the terminal.

A positive aspect of the embodiment shown in FIGS. 5A, 5B, and 5C is that the protrusion 30 has a self-supporting shape. The trailing side 32 provides mechanical support for the leading side 31 as the terminal 1 is incorrectly inserted. The lateral side 34 provides additional support to each of the sides. The resulting increase in mechanical strength allows for the protrusion 30 to be sized to provide a sufficient resistance to incorrect insertion, while reducing the risk that the protrusion 30 will fail.

Figure 6A:
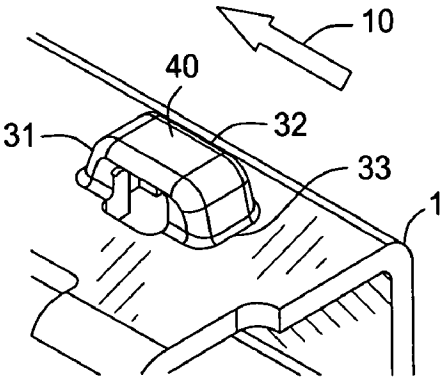
FIG. 6A shows a terminal having a protrusion in accordance with one embodiment of the present invention.
Figure 6B:
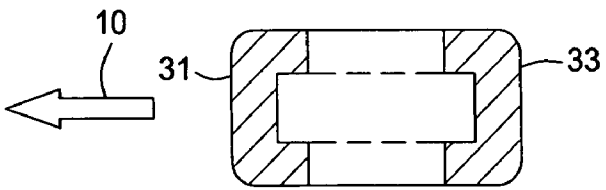
FIG. 6B shows a cross section of the protrusion shown in FIG. 6A. The cross section is parallel to the direction of insertion.

Turning to FIGS. 6A and 6B, a protrusion 40 in accordance with one embodiment of the present invention is shown. In this embodiment, the leading side 31 and trailing side 33 have "U" shaped cross sections as shown in FIG. 6B. The addition of "U" shaped cross sections increases the mass moment of inertia for the leading side 31 and trailing side 33, which increases the resistance of the protrusion 40 to bending. The increased stiffness of the protrusion 40 provides increased resistance to incorrect insertion. Accordingly, the risk of damaging the housing or the protrusion 40 is reduced.

Figure 7A:
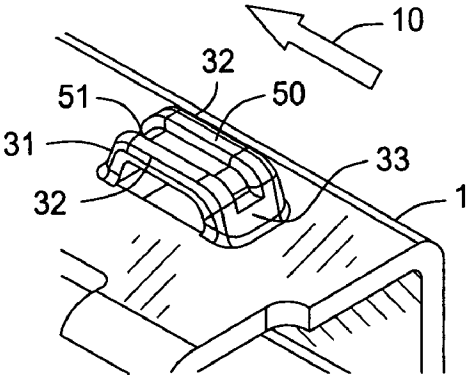
FIG. 7A shows a terminal having a protrusion in accordance with one embodiment of the present invention.
Figure 7B:
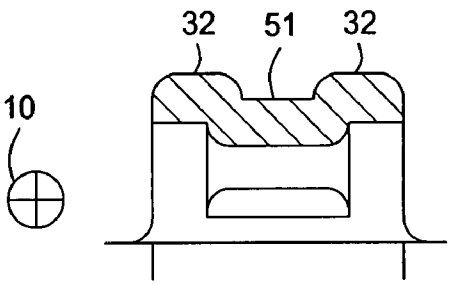
FIG. 7B shows a cross section of the protrusion shown in FIG. 7A. The cross section is perpendicular to the direction of insertion.

FIGS. 7A and 7B show another embodiment of the present invention. In FIGS. 7A and 7B, the protrusion 50 has a slot 51 formed in the top side 32. As with the "U" shaped cross sections shown in FIG. 6B, the slot 51 provides a similar increase in the mass moment of inertia of the top side 32. This increases the overall stiffness of the protrusion 40.

Each of the embodiments presented above provide shapes for a protrusion that may be formed from sheet metal. Those of ordinary skill in the art will appreciate that combinations of the protrusions disclosed above may be made without departing from the scope of the present invention. For example, the lateral side 34 shown in FIG. 5A may be combined with the slot 51 in the top side 32 shown in FIG. 7A. Protrusions in accordance with embodiments of the present invention exhibit increased stiffness and strength compared to the prior art protrusions for preventing incorrect insertions of terminals. Accordingly, the risk of incorrect insertion caused by failure of the protrusion or damage to the housing may be reduced by embodiments of the present invention.

Figure 1:
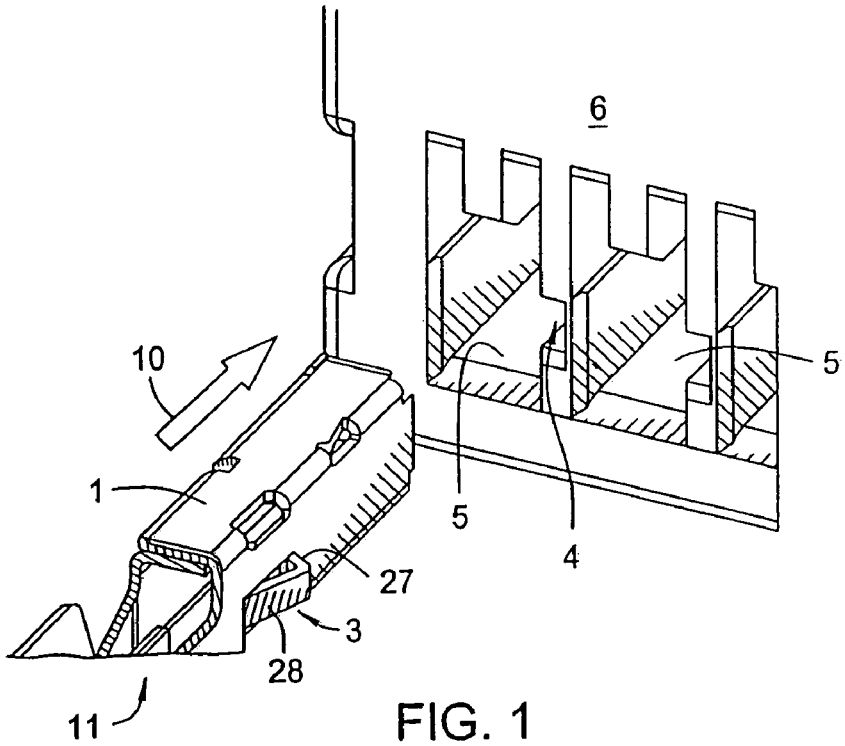
FIG. 1 PRIOR ART
FIG. 1 shows a perspective view of a prior art terminal being correctly inserted into a housing.
Figure 4:
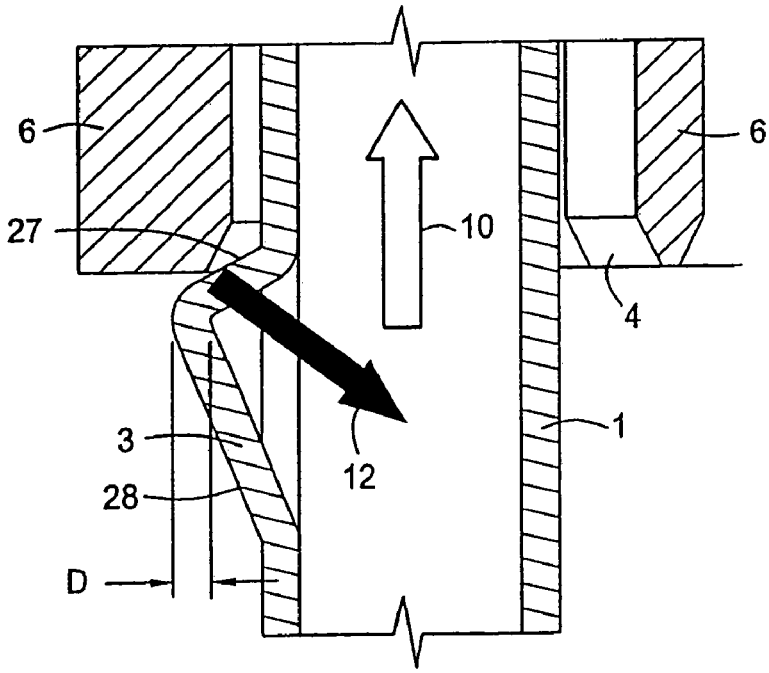
FIG. 4 PRIOR ART
FIG. 4 shows a cross section of a prior art terminal being incorrectly inserted into a housing.
Figure 2A:
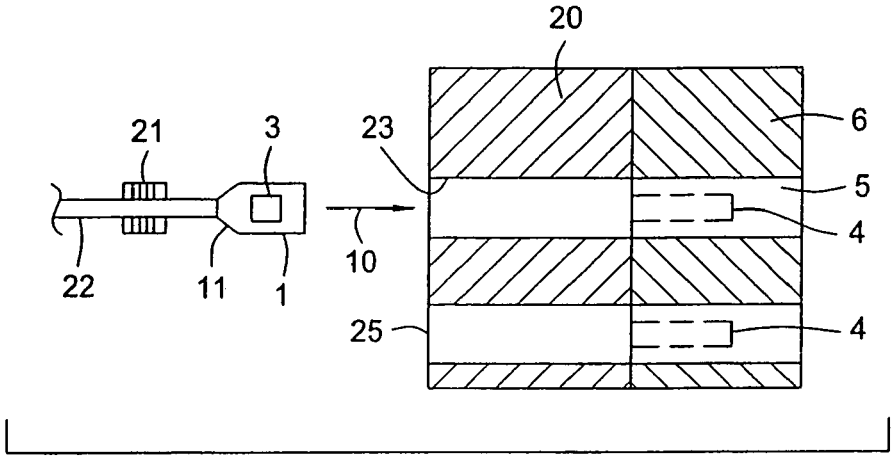
FIG. 2A PRIOR ART
FIG. 2A shows a side view of a prior art terminal being correctly inserted into a cross section of a housing.
Figure 2B:
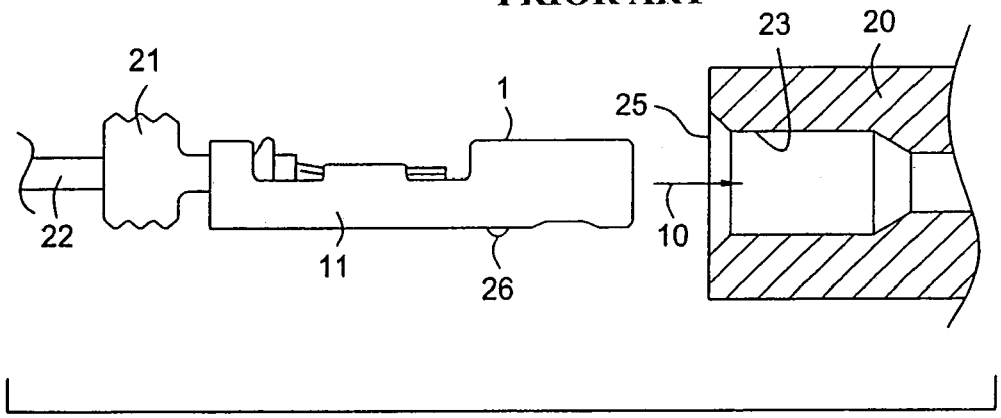
FIG. 2B PRIOR ART
FIG. 2B shows a side view of a prior art terminal being correctly inserted into a cross section of a housing.
Figure 3:
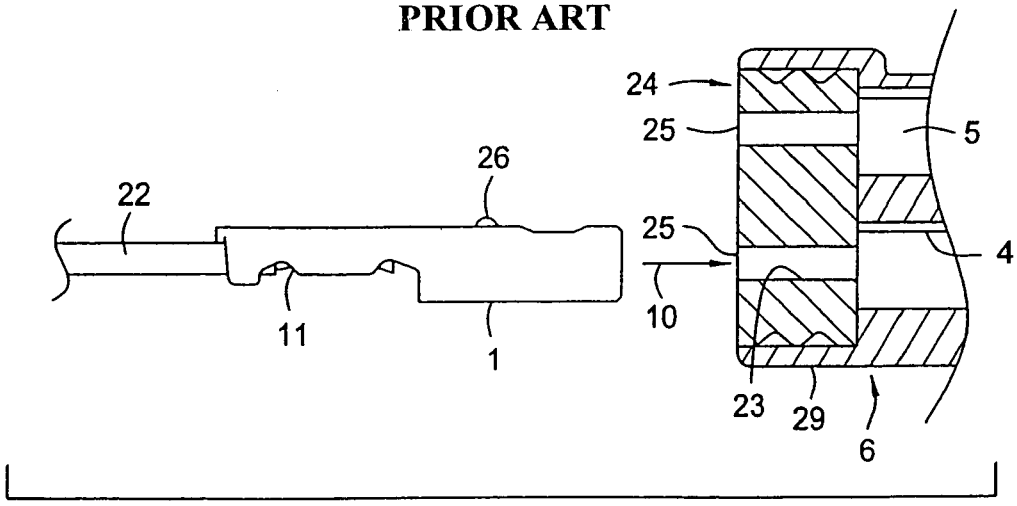
FIG. 3 PRIOR ART
FIG. 3 shows a side view of a prior art terminal being correctly inserted into a cross section of a housing.

Embodiments of the present invention are compatible with the waterproof connectors shown in FIGS. 2 and 3. In particular, the shapes of the protrusions reduce the risk of damaging the sealing element of a collectively-waterproofed type connector. The inclusion of a top side of the protrusion provides a broad contact area that decreases the contact pressure of the protrusion on the sealing member during insertion of the terminal. The reduction in contact pressure reduces the risk of cutting, scratching, or tearing the sealing member. As a result, the integrity of the sealing member and the waterproof quality of the connector may be preserved.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A terminal for preventing incorrect insertion into a housing, the terminal comprising:

a frame, wherein the frame is adapted to be received into a cavity in the housing;

a wire operatively connected to the frame; and a protrusion extending from the frame, wherein the protrusion comprises a leading side, a top side, and a trailing side, wherein the protrusion is configured to only allow a desired orientation of the terminal when inserted into the cavity, wherein the leading side forms a first obtuse internal angle with the top side, and the trailing side forms a second obtuse internal angle with the top side, wherein one of the leading side and trailing side has a "U" shaped cross section, wherein the frame and protrusion are formed from a single piece of sheet metal, wherein the leading side, the top side, and the trailing side of the protrusion each comprises a planar portion, and wherein the top side comprises a slot oriented in a direction of insertion of the terminal.

2. The terminal of claim 1, wherein the frame comprises four planar sides and the protrusion is disposed on one of the four planar sides.

3. The terminal of claim 1, wherein the protrusion comprises a lateral side extending from the leading side to the trailing side.

4. The terminal of claim 1, further comprising:

a sealing element disposed on the wire.

5. A method of correctly inserting a terminal into a housing of a connector, the method comprising:

orienting the terminal such that a protrusion disposed on the terminal is aligned with a slot formed in a cavity in the housing; and inserting the terminal into the cavity in the housing such that the protrusion passes though the slot, wherein the terminal comprises a frame, wherein the frame is adapted to be received into the cavity in the housing, a wire operatively connected to the frame, and the protrusion extending from the frame, wherein the protrusion comprises a leading side, a top side, and a trailing side, wherein the leading side forms a first obtuse internal angle with the top side, and the trailing side forms a second obtuse internal angle wit the top side, wherein one of the leading side and trailing side has a "U" shaped cross section, wherein the frame and protrusion are formed from a single piece of sheet metal, wherein the leading side, the top side, and the trailing side of the protrusion each comprises a planar portion, and wherein the top side comprises a slot oriented in a direction of insertion of the terminal.

6. The method of claim 5, wherein the connector is a collectively-waterproofed type connector comprising a sealing member disposed in the housing.

7. The method of claim 5, wherein the connector is an individually-waterproofed-cell type connector, and the terminal comprises a sealing element disposed on the wire.

8. The method, of claim 5, wherein the frame comprises four planar sides and the protrusion is disposed on one of the four planar sides.

9. The method of claim 5, wherein the protrusion comprises a latent side extending from the leading side to the trailing side.

* * * * *